US005194062A

United States Patent [19]

Membrino

[11] Patent Number: 5,194,062

[45] Date of Patent: Mar. 16, 1993

[54] MACHINE FOR PRE-FORMING AND REWINDING FILM FOR SIDE WELDED BAGS

[76] Inventor: Hercules Membrino, 280 Paoli State Road, Malvern, Pa. 19355

[21] Appl. No.: 779,105

[22] Filed: Oct. 18, 1991

Related U.S. Application Data

[63] Continuation-in-part of Ser. No. 539,129, Jun. 18, 1990, abandoned.

[51] Int. Cl.[5] ..... B65H 18/00; B31B 1/74

[52] U.S. Cl. ..... 493/203; 493/194; 242/67.5

[58] Field of Search ..... 493/193, 194, 195, 196, 493/197, 198, 199, 200, 201, 202, 203, 189; 242/67.5, 67.1 R, 67.2

[56] References Cited

U.S. PATENT DOCUMENTS

| | | | |
|---|---|---|---|
| 1,076,189 | 10/1913 | Cameron et al. | 83/506 X |
| 1,256,499 | 2/1918 | Cameron et al. | 242/67.5 |
| 2,157,054 | 5/1939 | Gammeter | 493/203 X |
| 2,936,815 | 5/1960 | Schjeldahl | 493/203 X |
| 3,086,577 | 4/1963 | Gimple | 493/199 X |
| 3,146,147 | 8/1964 | Naser | 493/202 X |
| 3,194,124 | 7/1965 | Ward | 493/197 |
| 3,497,129 | 2/1970 | Stein | 493/193 X |
| 3,511,435 | 5/1970 | Hewitt et al. | 493/202 X |
| 3,552,278 | 1/1971 | Guenther | 493/196 |
| 3,735,673 | 5/1973 | Sheehan et al. | 493/203 X |
| 3,783,750 | 1/1974 | Heimeijer | 493/196 |
| 4,747,815 | 5/1988 | Bonoit et al. | 493/194 |

OTHER PUBLICATIONS

LeMin, Joseph R., "Top Billing for Slitting From Converting Industry", *Paper, Film & Foil Converter,* Jul. 1989, pp. 72–73.

Lamson, Wade P. "Controlling Web Tension Critical in Center Winders", *Paper, Film & Foil Converter,* Aug. 1989, pp. 160–164.

Kirchner, Richard F., "Roll Winding Techniques Key to Slitting Success", *Paper, Film & Foil Converter,* Sep. 1989, pp. 124–130.

Rienau, John R., "Look At Winding Continues", *Paper, Film & Foil Converter,* Nov. 1989, pp. 92–96.

Weiss, Herbert. "Rewinders", *Technically Speaking,* North American Publishing Company, 1983, pp. 91–94.

Weiss, Herbert, "Print Length Control", *Technically Speaking,* North American Publishing Company, 1983, pp. 86–90.

Wainer, Michael V., "Technology, Performance Keys For Plastic Bagmakers", *Paper, Film & Foil Converter,* Apr. 1990, pp. 75–76.

Weiss, Herbert, "Lag-On Rollers Improve Quality", *Package Printing,* Sep. 1984, p. 54.

*Primary Examiner*—Bruce M. Kisliuk
*Assistant Examiner*—John A. Marlott
*Attorney, Agent, or Firm*—Dann, Dorfman, Herrell and Skillman

[57] ABSTRACT

An apparatus and method for processing and rewinding a web made of easily stretchably deformable plastic film or the like. The web is drawn from a supply roll assembly by a series of synchronously driven draw and transfer rolls and directly delivered to a rewind roll. The rewind roll is positively driven at a speed greater than speed imparted to the web by the draw and transfer rolls. However, the rewind roll is in peripheral contact with the last of the series of draw and transfer rolls so that the processed web is immediately transferred from the last web moving roll to the rewind roll, while the last roll exerts a drag on the rewind roll to control and match the speed of the rewind roll to the speed of the moving web.

12 Claims, 10 Drawing Sheets

FIG. 6
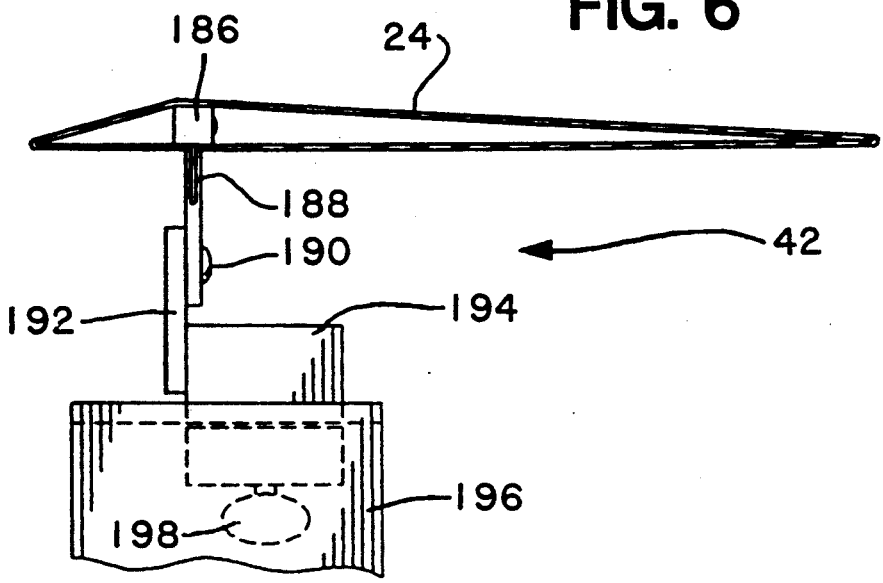
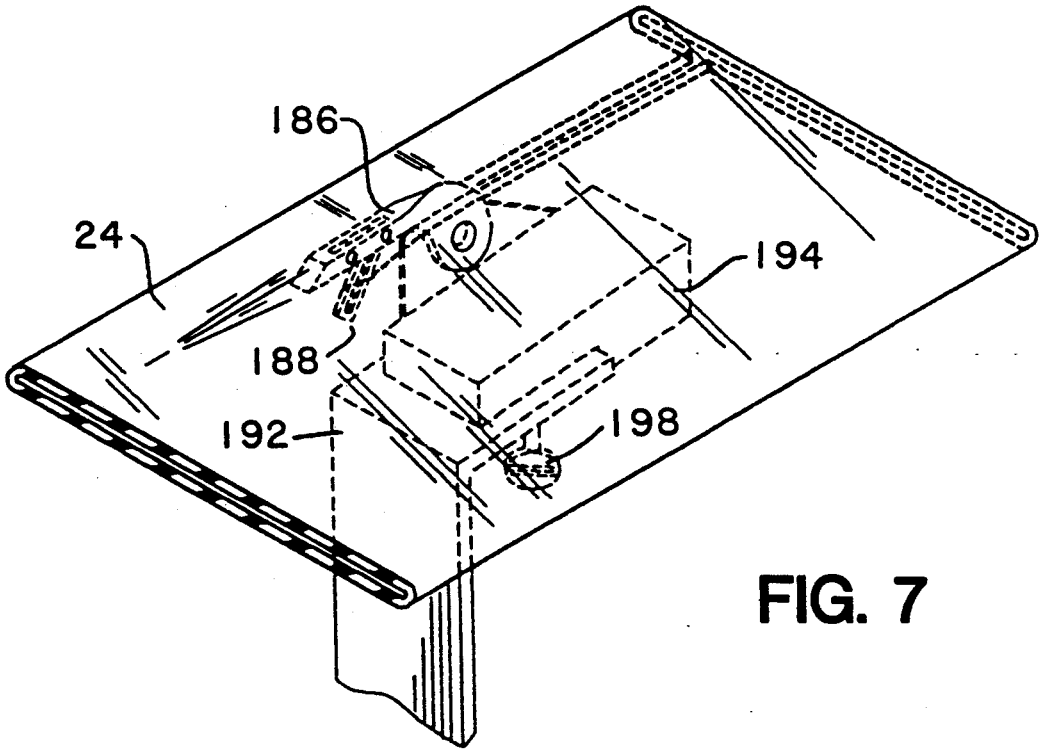
FIG. 7

MACHINE FOR PRE-FORMING AND REWINDING FILM FOR SIDE WELDED BAGS

This application is a continuation-in-part of my copending application Ser. No. 07/539,129, now abandoned entitled MACHINE TO PRE-FORM FILM FOR SIDE WELD BAGS, filed Jun. 18, 1990, which application is incorporated by reference herein as if fully set forth.

The present invention relates to a method and apparatus for the intermediate processing and rewinding of thin, flexible, plastic material to be used as an intermediate form before additional or final processing. Intermediate processing may include one or more trimming, slitting, folding, perforating and forming operations. The invention particularly relates to a simplified method and apparatus which eliminates the necessity of using electric tension or torque devices to eliminate undesirable stretching and air accumulation in rewinding rolls that are used for further processing.

BACKGROUND OF THE INVENTION

The intermediate processing of stock is known in the art as converting. The basic function of the converting industry is to convert flexible materials, such as paper, plastic, cardboard, light foil and the like, for use in the packaging industry. The conversion of these materials includes printing, slitting, rewinding, trimming, etc. A large volume of the material converted is in roll form.

In the various stages of the converting and handling of packaging material in roll form, many situations, conditions, and mistakes occur that causes material to be discarded or wasted. Many of the problems that arise are inherent in the machines that process and rewind the material. Much of the discarded material is capable of being salvaged.

There is a need for machines to reprocess and salvage this valuable material. Such machines must be capable of producing reprocessed rolls of material which are reconstructed and finished with the same quality and conformation as the original order specification requires.

Because of the variable characteristics of the packaging materials, one machine cannot handle all types of materials. This is especially true for the thin, stretchably deformable plastic webs. Such plastic webs take a variety of forms such as sheeting, tubing, multi-ply film, etc.

Often there is a need for reprocessing pre-printed plastic web on which printed matter appears in a predefined regular interval. In reprocessing such material, it is imperative that the plastic film is not stretched which would adversely effect the registration of the printed matter over the length of the plastic web.

Preventing stretch is particularly problematic in conjunction with rewinding the reprocessed material to produce an acceptable rewound roll. There are two types of rewinders in general use for rewinding plastic pre-formed web material onto storage rolls, namely surface driven rewinders and center driven rewinders.

Surface driven rewinders include one or more driven rollers whose surface makes contact with the outside layer of material being rewound on a freely rotatable core. The surface rewinder's driven rollers are driven at a speed slightly higher than that of the moving web so as to create a positive pull or tension.

A major disadvantage of this type of machine is that the pressure on the driven rollers increases as the roll diameter increases due to the ever increasing weight of the rewind roll as it is being rewound. As a result, a minor amount of air is squeezed out of the inner layers and a major amount is squeezed out of the outer layers. This makes for a soft inner roll and a hard outer roll; this can cause problems when the roll is placed in a different machine for further processing. This can also cause telescoping and irregularly shaped rolls. In order to maintain equal surface pressure throughout the build-up of the roll, it is necessary to provide additional mechanical, pneumatic or hydraulic counterforce mechanisms. These mechanisms add to the complexity and cost of the machine.

In center driven rewinders, the spindle on which the web of material is rewound to produce the rewind roll is driven. The web is pulled by the rewind roll as succeeding layers of material are continuously applied.

It is problematic to maintain constant tension on the web to achieve uniform web pull, since the weight of the rewind roll increases and the circumferential speed of the growing roll also increases. The increasing weight requires an ever increasing motor torque in proportion to roll diameter. Further, the speed of a center driven core is in inverse proportion to roll diameter. Although the driven core's speed must be reduced as the rewind roll's circumference increases, the required horsepower must remain constant throughout the roll build-up.

Few, if any, constant horsepower drives have heretofore been able to provide a constant horsepower output throughout the build-up range of a rewind roll. Further, center driven rewinders usually employ excessive tension on the web to remove the air between layers of material. This can result in stretching and eventual tearing of the web, particularly when the web is a thin plastic material.

Freely rotating doctor rolls are known in the art which engage the surface of a center driven rewind roll to facilitate the removal of air from the roll. However, the center driven rewinder is still required to exert a pulling force on the web to maintain web tension.

SUMMARY OF THE INVENTION

The present invention provides an improved apparatus for processing and rewinding webs of thin plastic material. The apparatus includes a positively-driven set of draw and transfer rolls. These rolls draw a web from a supply roll and transport it at a constant speed for one or more processing operations. Accordingly, the web moves over and around a series of driven transfer rolls. During which time the web may be trimmed, folded, slitted, perforated, punched, cut, inspected or subjected to any other desired processing of the film. The draw and transfer rolls are driven in harmony by a gear linkage.

Unlike conventional apparatus, a center driven rewind assembly is intimately associated with the last one of the series of draw and transfer rolls. This enables the moving web to be delivered to the rewind roll without a deterioative longitudinal tension being applied to the web.

The driven set of draw and transfer rolls perform the primary task of pulling the web from the supply roll across and through various processing areas. The combination of draw and transfer rolls driven in unison provides a constant and uniform tension on the web preventing stretching of the web.

The last roll in the set of draw and transfer rolls is a relatively larger diameter web moving drum. The web moving drum is designed to perform several important tasks in the intermediate processing of a web of thin plastic film. The diameter of the web moving drum is determined by the gauge or thickness of the web to be moved and the number of desired slits or cuts into the web. The web moving drum has a relatively large circumference which allows a more even pull on the web, thereby further obviating any tendency of the web to wrinkle. Further, a large web moving drum circumference is needed for proper slitting (razor type) of the web. If the degree of arc of the material at the area of cutting is too great, slitting becomes problematic.

The rewind assembly maintains the rewind roll in peripheral contact with the web moving drum. Accordingly, this permits multiple strips from a slitted web to be directly delivered and transferred to the rewind roll without any distortion, stretch or edge overlap.

The intimate association of the rewind assembly and the web moving drum through peripheral contact eliminates the need for drawing the web onto the rewind roll. The rewind roll, accordingly, only requires a limited amount of over-pull to assure the uniform rewinding of the web.

To maintain the peripheral speed of the rewind roll at substantially the same speed as the moving web, the web moving drum provides a drag on the over-driven rewind roll. This drag is a force essentially orthogonal to the web and, accordingly, does not impart a longitudinal stretching force on the web. The association of the rewind roll with the web moving drum and the over-pull created by the rewind spindle uniformly rewinds the individual portions of a slitted web throughout the rewind roll formation.

The rewind spindle may be driven by a separate motor than the one that drives the web moving drum so long as means are provided for permitting the drag of the web moving drum to slow the rewind roll. Preferably, the rewind spindle is mechanically linked to the drive train of the driven draw and transfer rolls. A slippable clutch is provided to permit the drag by the web moving drum to control the speed of the rewind roll.

The driven rewind spindle "floats" to accommodate the increasing diameter of the rewind roll as the amount of web thereon increases. The "floating" rewind spindle allows the rewind roll to move perpendicularly with respect to its axis. This "floating" contact not only acts to squeeze out any air within the plies of the web, but substantially eliminates any stretching of the web because of the immediate delivery and transfer thereof from the web moving drum to the rewind roll. It also eliminates any separation or distortion of the longitudinally slitted portions of the web due to axial movement away from each other.

The "floating" rewind spindle also permits relatively uniform pressure between the web moving drum and the rewind roll to be maintained. The amount of pressure is determined by selectively weighting the spindle assembly. The weight of the roll will also tend to increase the pressure between the web moving drum and the rewind roll. However, unlike conventional surface rewinders, the driven rewind spindle of the present invention assures uniform roll rewinding.

The intimate association of rewind assembly with the draw and transfer rolls retains all the advantages of a conventional-type center driven rewinder, but a constant horsepower, variable torque motor is not needed to maintain a constant tension of the web during roll build-up. The tension of the web is maintained by the over-pull of the rewind roll which is controlled by peripheral contact with the web moving drum and the slippable clutch. The invention disclosed in the instant application maintains a uniform and consistent roll conformation so that the web can be placed on another apparatus for further processing. In particular, pre-printed thin plastic film can be processed and rewound without any deteriorative effect on the registration of the printed matter.

Preferably, the spindle of the rewind roll comprises a drive portion and a core holding portion which are separable to permit removal of the cores containing the processed rewound web. The core holding portion is preferably adapted to hold one or a plurality of axially contigious cores. For multiple cores, each core corresponds to a portion of the web formed by longitudinal slitting.

An object of the present invention is to eliminate the deteriorative stretching effect of longitudinal "pulling" of thin plastic film inherent in conventional surface driven and center driven rewinders. The present invention accomplishes this by "delivering" the web to the rewinding roll. A "pinching action" between the web moving drum and the rewind roll removes the air between the plies and controls the overdriving force of the rewind spindle. The floating driven rewind spindle facilitates a uniform roll conformation without the need of costly auxiliary web tension controls.

The machine disclosed herein is especially well adapted to form, trim, salvage, slit and rewind thin, extendable and highly slippable plastic film, e.g. polyethylene, polypropylene and the like. Such film is conventionally on the order of thickness of one mil or less. Pre-printed stock can be slit into multiple smaller rolls without adversely effecting print registration for further processing on such equipment as bag making machines, package wrapping, form and fill and the like.

The apparatus moves and processes the thin plastic web, especially pre-printed web, from the stock roll into finished smaller rolls without distorting or stretching the web. This allows an effective mechanical method of rewinding the web, without the need of electrical sensors, multiple clutches and variable electrical controlling devices.

BRIEF DESCRIPTION OF THE DRAWINGS

FIG. 6 is an enlarged sectional view taken on line 6—6 of FIG. 2 showing the cutout slitters and lip maker.

FIG. 7 is a perspective view of the mechanism of FIG. 6.

DETAILED DESCRIPTION OF THE PREFERRED EMBODIMENT

Figure 1:
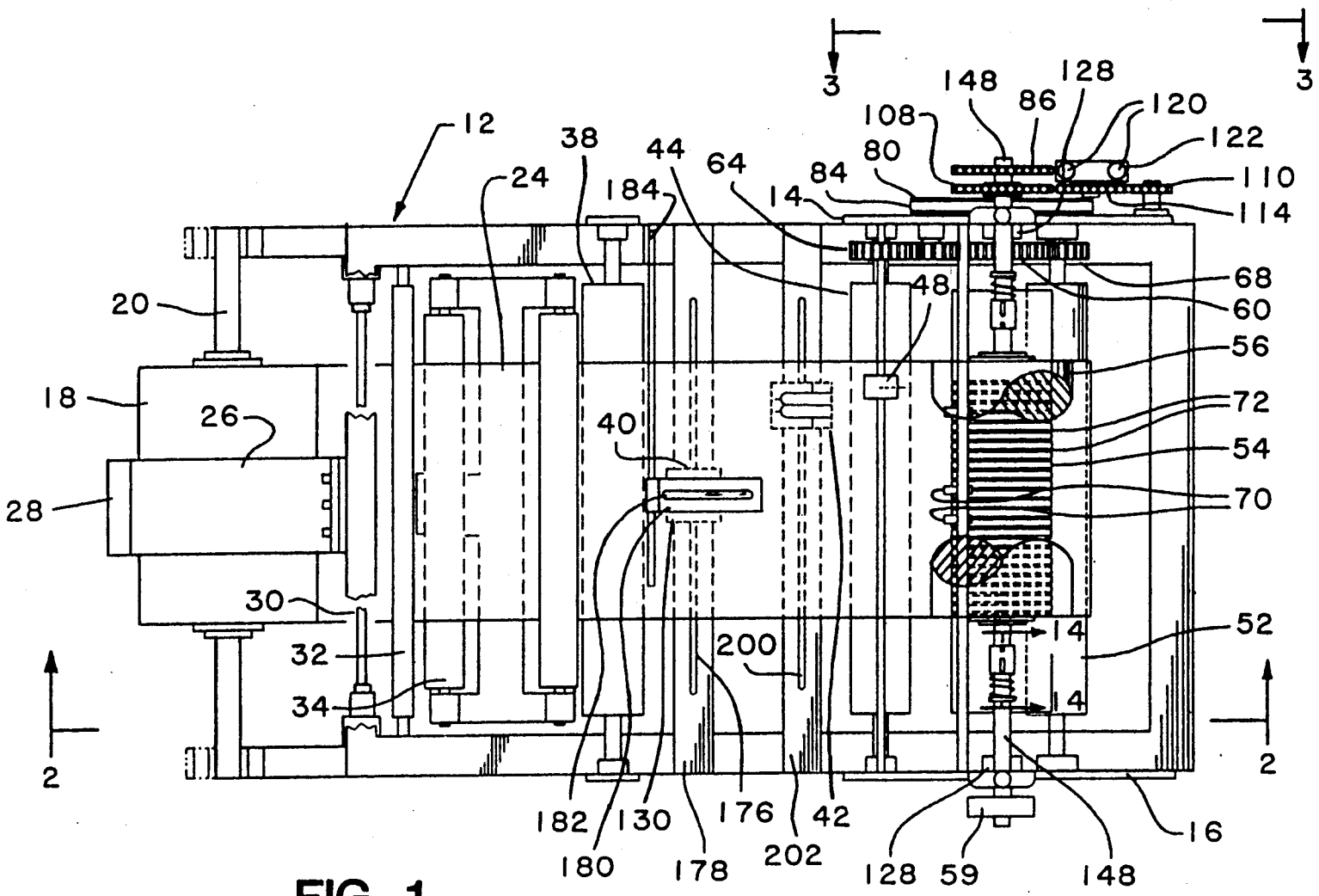
FIG. 1 is a top plan view, partially broken away, of a machine embodying the present invention.

Referring more specifically to the drawings, FIG. 1 shows a machine, generally designated 10, which comprises a frame 12 including a pair of oppositely-disposed side plates 14 and 16 at one end of the frame.

A web 24 is drawn from a supply roll and impelled by and through various processing areas by a series of driven draw and transfer rolls 44, 50, 52 and 54. These rolls are linked through gears to rotate in unison to impart motion to the web without stretching or otherwise deforming it.

A variety of processing operations are disclosed in detail below. However, only one or two operations are usually performed in a particular processing run. In some instances, it may be desired to rewind a roll of material without any other processing. Processing blades and mechanisms which are not used during a particular run are withdrawn or removed.

The supply roll 18 (best shown in FIG. 2) comprises a rotatable spindle 20 and a core 22 on which are wound a web 24 of thin plastic film, in single or multi-ply sheet, in a tubular configuration or the like. A hold-down strip 26 extends from the frame to overlap the upper layer of the web 24. The strip 26 has a weight 28 which acts to hold the strip 26 in a pressure position on the roll 18 to maintain the web taut.

The web 24 extends between a pair of guide rollers 30 and around a turn-around idler roller 34, under a turn-around idler roller 36, over a turn-around idler roller 38, over a hot, slit and seal knife assembly 40, between a driven anvil roller 44 and a slicing or perforating wheel 46 forming part of a mechanism generally designated 48, around a driven roller 50, around a driven pinch roller 52, around a driven web moving drum 54, and then around a rewind roll 56 mounted for rotation on a center rewind spindle 164. A counterweight 59 is attached to one end of the rewind spindle 164 to balance the pull of the chain drive so that the spindle exerts evenly distributed pressure on web moving drum 54.

The shaft 82 of the web moving drum 54 is provided with a gear 60 that drives a gear 62 which, in turn, drives a gear 64 of the anvil roller 44. The gear 64 drives the gear 66 of the roller 50. The gear 60 on the shaft of drum 54 also drives a gear 68 of the pinch roller 52. This gear arrangement provides synchronous rotation of the web moving drum 54 and the associated rollers 44, 50 and 52 to uniformly draw and maintain the tension and movement of the web.

Figure 3:
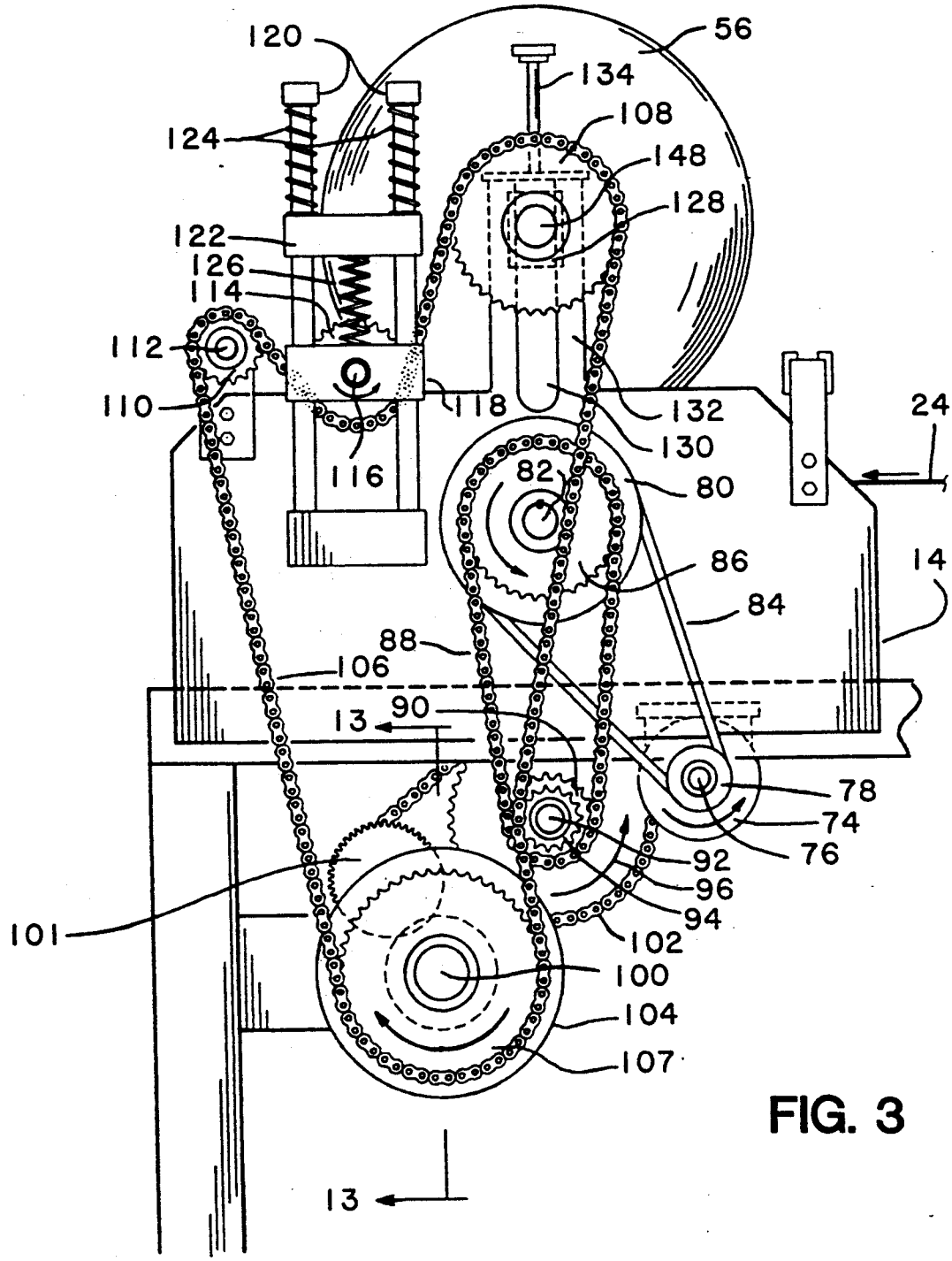
FIG. 3 is an enlarged detailed side elevational view of the drive assembly taken on line 3—3 of FIG. 1.

As best seen in FIG. 3, the web moving drum 54 is driven by a drive means comprising a motor 74 having a drive shaft 76 on which is mounted a pulley 78. Pulley 80 is mounted on a shaft 82. The pulley 78 is operatively connected to pulley 80 by a drive belt 84. Coaxial with the pulley 80, is a sprocket 86 that is mounted on the shaft 82. This sprocket 86 is operatively connected by a chain 88 to a driven sprocket 90 mounted on a driven shaft 92. An idler sprocket 94 is mounted coaxially with sprocket 90 on shaft 92. The shaft 92 supports a driven sprocket 96 which is connected to a driven sprocket 98 on a shaft 99 by a chain 102.

The sprocket 96 has a larger diameter than the sprocket 98 so that there is an increase of speed of the sprocket 98 relative to the sprocket 96. Shaft 99 is associated with shaft 100 by gears 101 and 103. This changes the direction of rotation of the drive force from that of shaft 99. The shaft 100 supports a slip clutch 104, hereinafter more fully described.

The slip clutch 104 is provided with a drag that is transferred from the slip clutch sprocket 107 through a chain 106 to a "floating" sprocket 108 via an idler sprocket 110 mounted on a shaft 112, and to a "floating" idler sprocket 114 mounted on a spring-pressed shaft 116. The shaft 116 is mounted on a block 118 movable on rods 120. A block 122 is spring-pressed downwardly by springs 124 mounted on the rods 120 and is spring-pressed upwardly by a spring 126 positioned between the block 118 and the block 122. The sprocket 94 acts to tension the chain 106 prior to its movement onto sprocket 107. This spring-pressed construction provides compensation for any slack in the chain 106 due to variation in the diameter of the rewind roll 56 as the amount of rewound material on the roll varies. As noted above with reference to FIG. 1, counterweight 59 balances the pressure exerted on the spindle by drive chain 106.

The shaft 148 is mounted between blocks 128 which move vertically in slots 130 of standards 132 on the frame. This permits the spindle 164 and the rewind roll thereon to automatically move upwardly or "float" as the diameter of the roll 56 increases. When the spindle reaches its top most position, it is temporarily locked in place by the set screws 134. This permits removal of the spindle core(s) and its rewound roll (or rolls) from the machine and replacement with an empty core(s). The set screws 134 are then released to permit the spindle to move downwardly.

Figure 13:
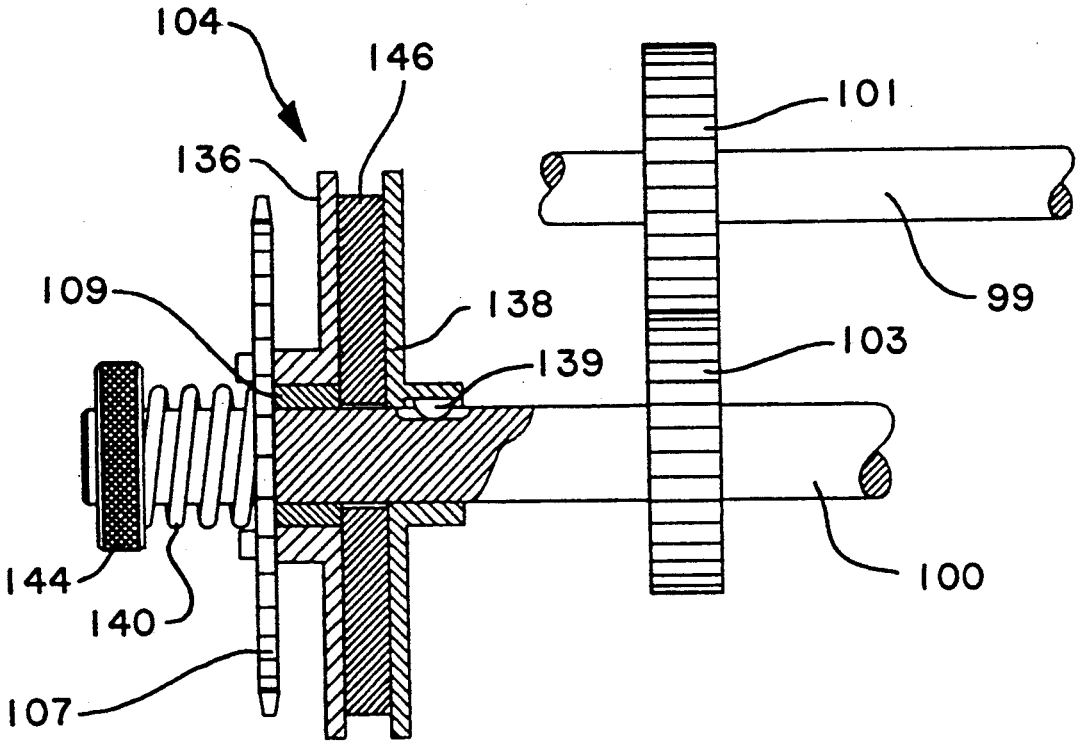
FIG. 13 is a sectional view taken on line 13—13 of FIG. 3 of the slippable clutch mechanism.

The slip clutch 104 is shown in detail in FIG. 13 and comprises two face plates 136 and 138. Face plate 138 is connected to drive shaft 100 via key 139. Face plate 136 is rotatably mounted on shaft 100 via a bearing 109. Between the two plates 136 and 138 is a friction disc 146 which exerts a drag between the two face plates. Sprocket 107 is rigidly affixed to plate 136. A spring 140 extending around the shaft 100 and bearing against the sprocket 107, spring presses plate 136 against plate 138. A nut 144 engaged with a threaded end of shaft 100 is provided to adjust the tension between plates 136 and 138.

Figure 14:
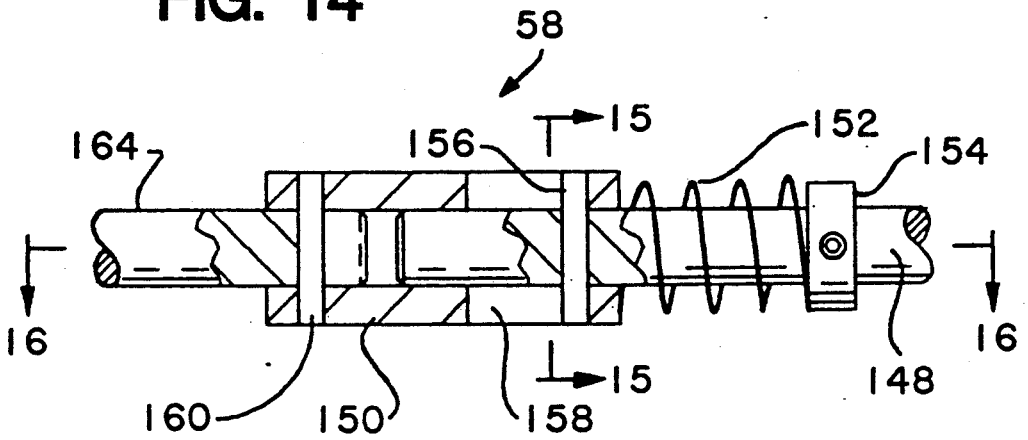
FIG. 14 is an enlarged sectional view taken on line 14—14 of FIG. 1 of the removable spindle assembly.
Figure 15:
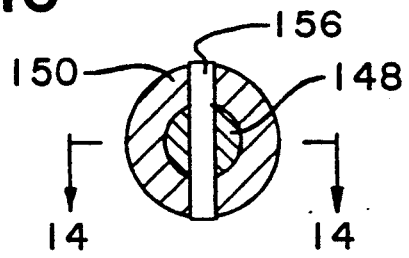
FIG. 15 is a sectional view taken on line 15—15 of FIG. 14 of the drive axis and associated pin.
Figure 16:
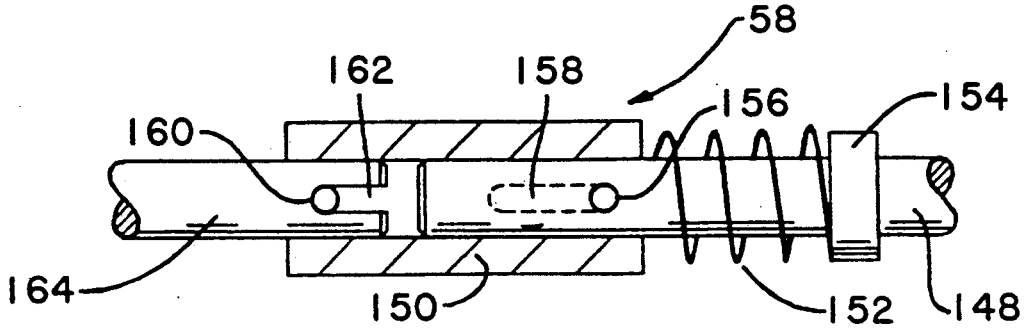
FIG. 16 is a sectional view taken on line 16—16 of FIG. 14 of the removable spindle assembly.

The spindle assembly 58 is shown in more detail in FIGS. 14, 15 and 16 and comprises a drive shaft 148 upon which a sleeve 150 is slidably mounted. A spring 152 is disposed on the shaft 148 between the sleeve 150 and an adjustable collar 154. The spring 152 biases the sleeve 150 into engagement with a spindle portion 164. The shaft 148 is driven by the sprocket 108 and is connected to the sleeve 150 by a pin 156 disposed in opposing slots 158 in the sleeve. The sleeve is provided with a pin 160 which engages spindle portion 164 by extending through a slot 162 in the end of the spindle portion 164. The spindle portion 164 is removable from the sleeve 150 by sliding the sleeve to the right to release the pin 160 from the slot 162. The connection between the spindle portion 164 and the sleeve 150 is releasably maintained by the spring 152 until the spindle portion 164 is positively removed. A similar slide sleeve mechanism is used to lock and release the opposing end of spindle portion 164 as shown in FIG. 1.

Figure 11:
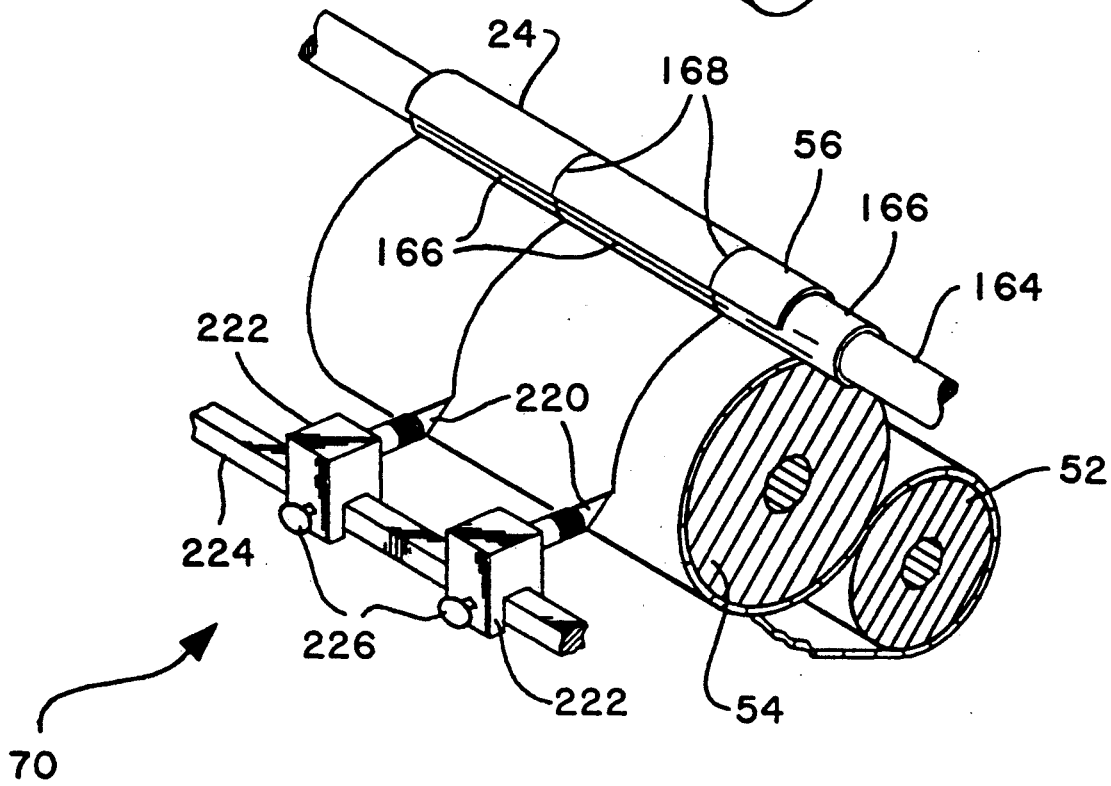
FIG. 11 is a perspective view of the web moving drum and rewind roll showing multiple slitters used in conjunction with the drum.

The spindle portion 164 is adapted to hold either one or a plurality of cores 166. Three axially arranged cores 166 are shown in FIG. 11. These cores received the rewound web 24 which, as shown in FIG. 11, has been slit, as at 168, to form three separate rolls. These rolls are removable from the spindle by removing the spindle portion 164 in the manner described above. Empty cores are then installed on spindle portion 164 which is then reinstalled on the machine.

FIGS. 4 through 11 illustrate a variety of different ways of processing the web. The types of processing in a particular instance is determined by need and may include one or more of the processing operations.

Figure 4:
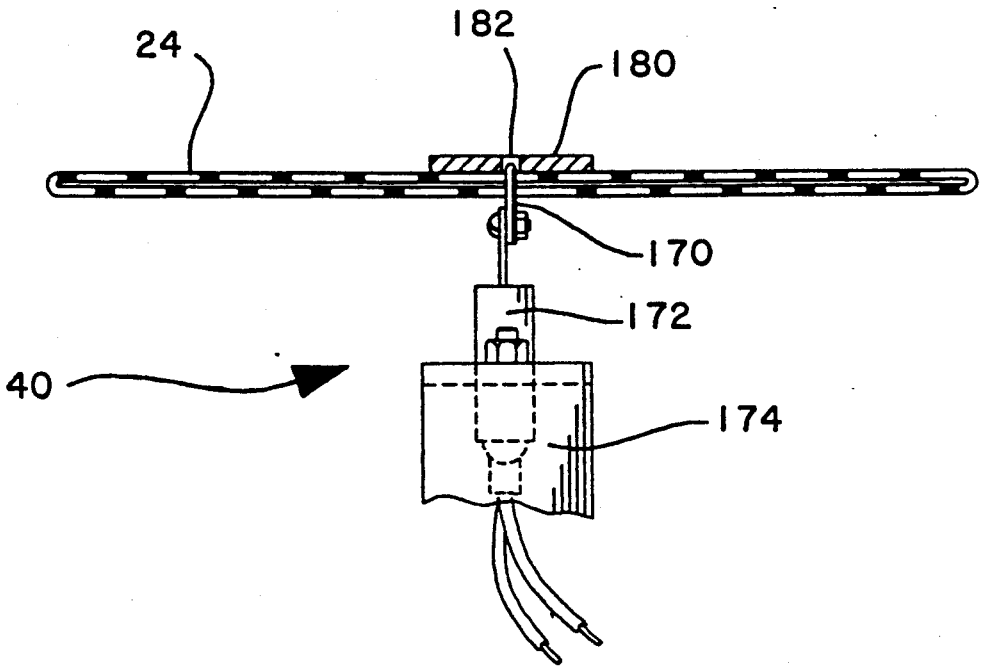
FIG. 4 is a sectional view taken on line 4—4 of FIG. 2 showing the slit and seal knife.
Figure 5:
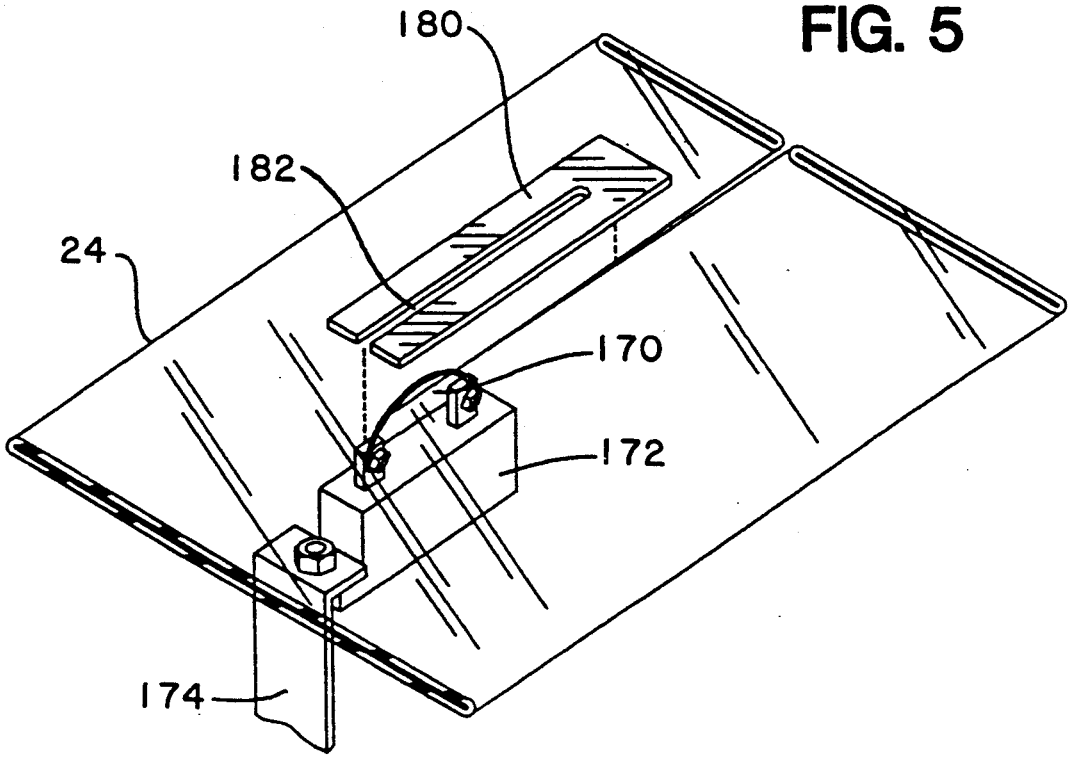
FIG. 5 is a perspective view of the slit and seal knife of FIG. 4.

The web may be tubing, overlapped plies of sheet or film, or the like. FIGS. 4 and 5 illustrate the processing of a web 24 having a tubular configuration. First the web 24 passes over the slit and seal assembly 40 where it is longitudinally slit and heat sealed by a heated blade or knife 170 (see FIGS. 4 and 5). The knife 170 is mounted on an electrical heating element 172 mounted on a bar 174 transversely adjustable along a slot 176 in a transverse plate 178 and adapted to be held in adjusted position by a set screw or the like. The heated blade 170 co-acts with a clamping plate 180 having a slot 182. This clamping plate 180 overlies the web 24. The heated blade is received in the slot 182 during the slitting process The clamping plate 180 is transversely adjustable along a rod 184 and may be held in adjusted position by a set screw or the like. This transverse adjustment of the blade and clamping plate permits the slitting to take place at any desired lateral position. If desired, a plurality of such heated slitting means may be provided.

In making the bags being used as illustrative of the present invention, it is often desirable to form a lip at the mouth of the finished bag. This lip is formed by cutting or slitting only one wall of the bag to form an open mouth while leaving the other edge portion intact. The assembly 42 which accomplishes this is more specifically shown in FIGS. 6 and 7 and comprises a plough 186 and a slitter 188 pivotally mounted at 190 on a bracket 192 extending from a block 194 connected to a bar 196 by a set screw 198. The bar 196 is transversely adjustable along a slot 200 (see FIG. 1) in a plate 202 and is held in adjusted position by a set screw or the like. The transverse adjustment permits the device to be used at any desirable lateral position. If desirable, a plurality of such slitter assemblies may be provided.

In operation, the plough 186 is initially set between the upper and lower plies of the tubular web 24 with the slitter 188 under the lower ply. As the web 24 moves through the machine the plough 186 spaces the upper ply from the lower ply so that the slitter 188 slits only the lower ply.

Figure 8:
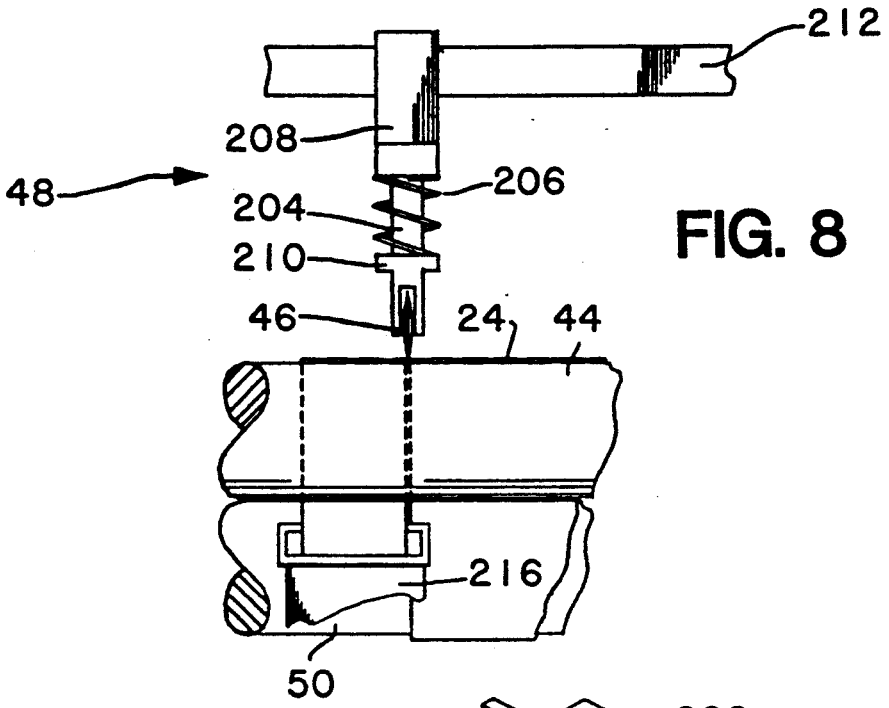
FIG. 8 is a sectional view taken on line 8—8 of FIG. 2, showing the perforating wheel and associated elements.
Figure 9:
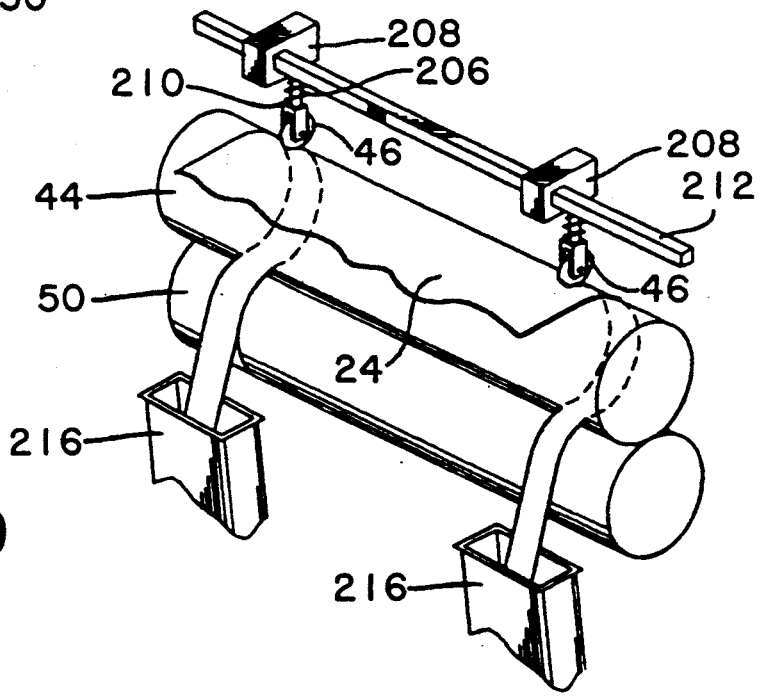
FIG. 9 is a perspective view of the mechanism of FIG. 8.

Excess material may be severed and disposed of by the mechanism generally indicated at 48 and more specifically shown in FIGS. 8 and 9. It comprises the rotary cutter 46 supported by a rod 204 which is spring-pressed by a spring 206, positioned between a bearing portion of a block 208 and a collar 210. The cutter 46 makes peripheral contact with anvil roller 44. The block 208 is laterally adjustable along a rod 212 extending across the frame 12. The excess or waste material severed by the cutter 46 is drawn into a waste receptacle 214 (see FIG. 2) through a vacuum tube 216 of a standard type.

Figure 10:
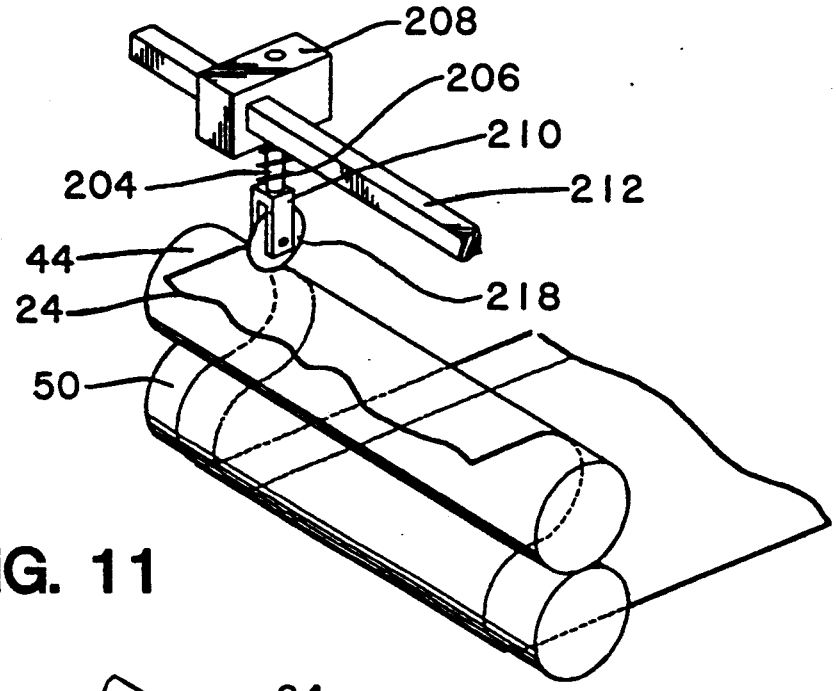
FIG. 10 is a perspective view of an alternative perforating wheel in the form of a perforator.

If it is desired to provide a line of perforations rather than a total slitting, the cutter 46 may be replaced by a serrated disc such as shown at 218 in FIG. 10. Otherwise, the mechanism is the same as in FIG. 9; however, since there is no complete severance of any material, the vacuum tube and waste receptacle may be eliminated.

Figure 12:
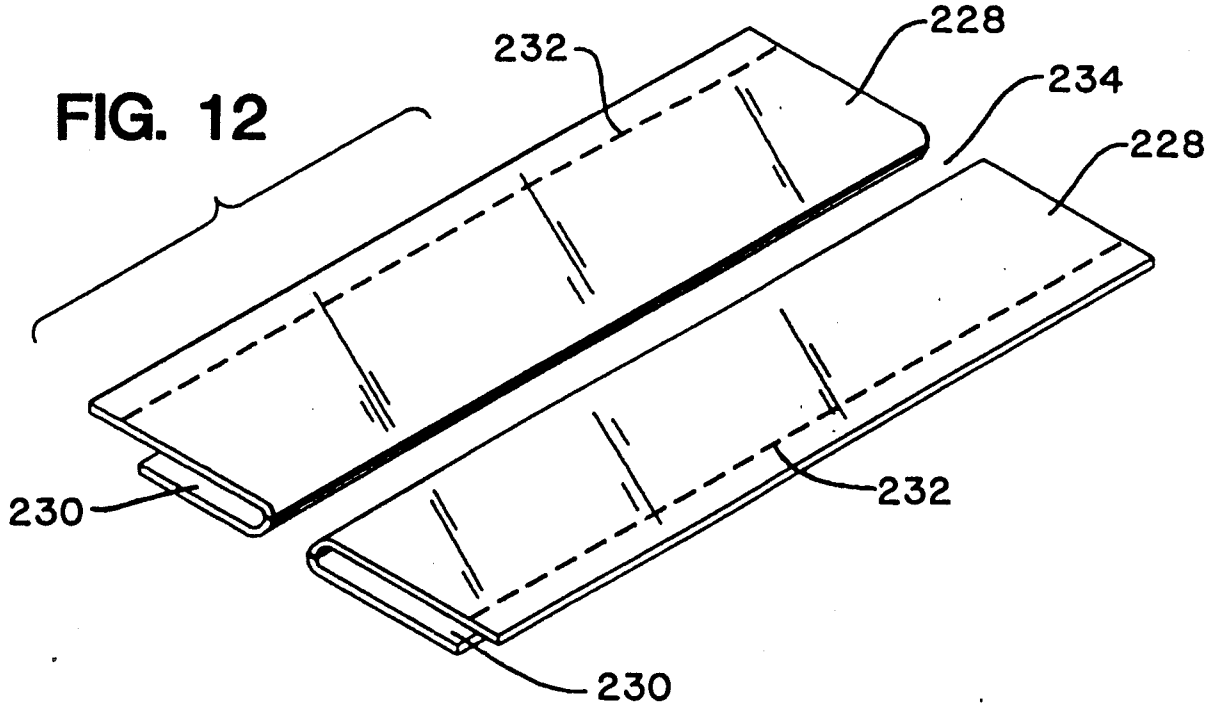
FIG. 12 is a perspective view of a processed material after having been cut and perforated.

FIG. 12 is illustrative of a pair of bag forms, designated 228, after they have been processed by the above-described machine but before they have been finally cut and sealed to form the actual bags. The lips 230 have been formed by the mechanism 42 shown in FIG. 6 and the severance between the two units, shown at 234, was provided by the hot blade mechanism 40 shown in FIGS. 4 and 5.

FIG. 11 is a detailed illustration of the slitter assembly 70 showing two slitter blades 220, each extending from a block 222 slidably mounted on a rod 224 for lateral adjustment. The slitters 70 make contact with the periphery of the web moving drum 54 to longitudinally slit the web. Optionally, peripheral grooves 72 may be provided on the drum 54 and are used in conjunction with the slitters 70.

A set screw 226 holds each slitter block 222 in position. The slitters 220 may be omitted if only one core is used. The number of slitters 220 depends on the number of cores 166 on the spindle 164. Three cores 166 and two slitters 220 are, however, usually preferred.

Figure 2:
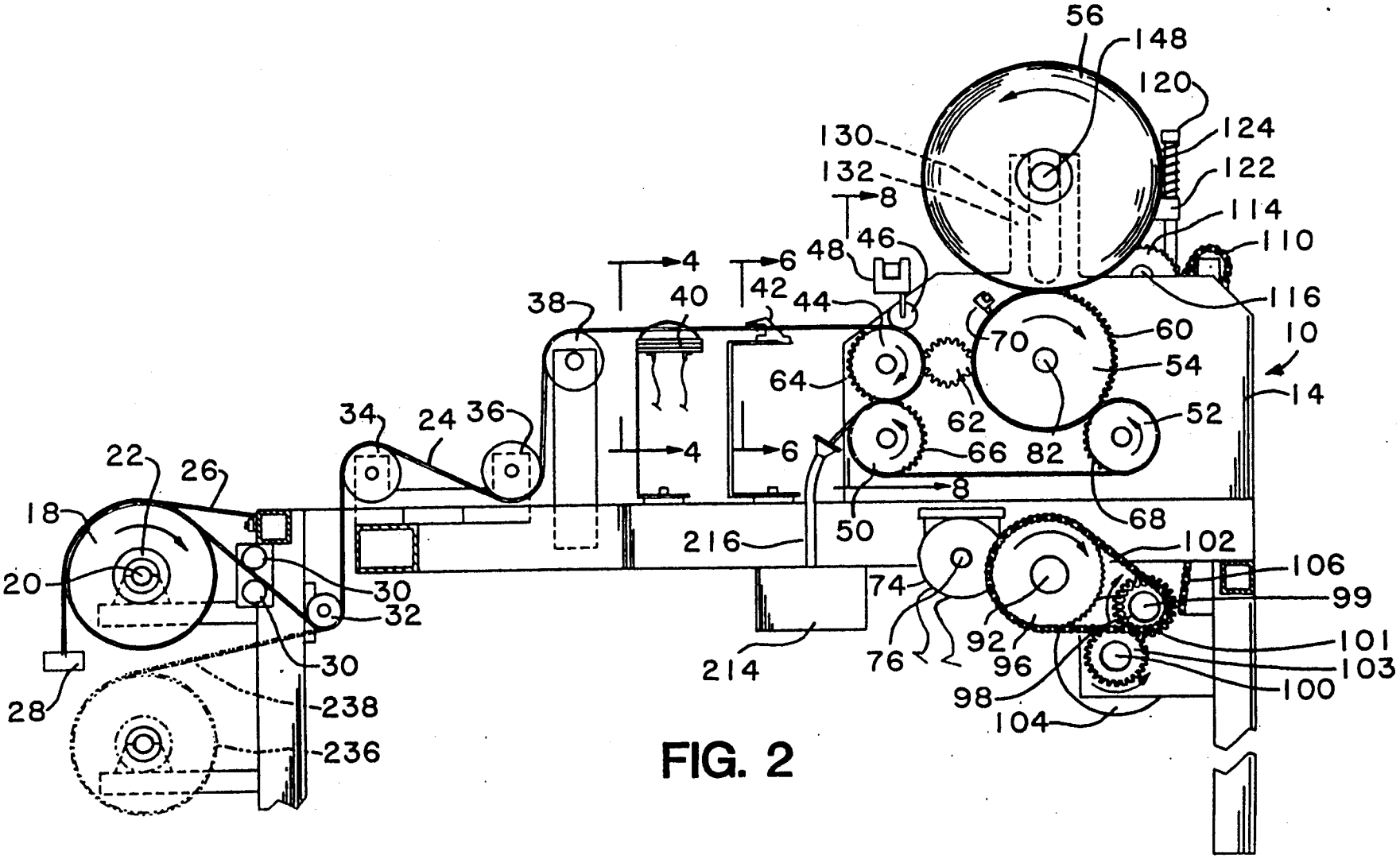
FIG. 2 is a sectional view taken on line 2—2 of FIG. 1.

A significant aspect of the present invention is the intimate relationship between the web moving drum 54 and the rewind roll 56 (as best shown in FIGS. 2 and 11). This relationship provides for immediate take-up of the web onto the roll 56, thereby preventing any sag which would affect the tension on the web 24 and cause possible wrinkling. The contact between the drum 54 and rewind roll 56 also acts to press any adhering air out of the web. The immediate transfer prevents edge overlap between the rolls on the axially arranged cores because there is no time for the rolls to separate and, therefore, the edges cannot become distorted.

Web moving drum 54 performs many functions. Drum 54 assists in transforming the web and delivering it at uniform rate and tension directly to the rewind roll 56. Drum 54 is in peripheral contact with the rewind roll 56 and acts as a drag on the rewind roll. The rewind roll 56 is center driven, at a faster rate than the draw roll 54, to keep the rewound web tight. The drag allows the rewind roll 56 to take up the web 24 without stretching the web. The association of the drive drum 54 creates an effect on the rewind assembly such that it resembles a surface driven rewinder. Therefore, the advantages of a center driven rewinder and a surface driven rewinder are achieved without the inherent disadvantages of each of those systems.

The invention has been described above in conjunction with the use of a tubular web. However, sheet material may also be used to form a double ply material. For this purpose, an optional second supply drum or roll, designated 236, and shown in FIG. 2, may be used. This roll 236 is mounted on the frame in similar manner to the roll 18 but below it (as shown in FIG. 2). The material 24 from the upper roll 18 would then be sheet-like rather than tubular and a similar sheet-like material, designated 238, would be applied from the roll 236 around the roller 32, where it would mate, face-to-face, with the sheet material from the roll 18 and form a double ply web. From that point on the process would be the same as described above.

Although the invention has been described with particular regard to bag making, it is not necessarily limited thereto; it may be used with the processing of plastic webs in general. In this respect, if the various cutting, perforating and sealing devices described above are not utilizable in the particular process being employed, they may be made inoperative or even removed as desired.

I claim:

1. An apparatus for processing and rewinding an easily stretchably deformable web made of thin plastic comprising:

(a) a series of synchronously, positively driven draw and transfer rolls for drawing the web from a supply roll and transporting it at a uniform speed and tension through at least one processing area, said series having a positively driven last roll; and (b) a center-driven rewind roll in moving peripheral contact with said last roll such that the moving web is directly delivered to said rewind roll by said last roll and transferred at a transfer point provided at the peripheral contact between the last roll and the rewind roll from contact with said last roll into contact with said rewind roll, said last roll exerting a drag on said rewind roll for controlling the speed of the rewind roll so that the web is rewound onto the rewind roll under constant tension without stretching.

2. The apparatus of claim 1 wherein said rewind roll is resiliently movable transverse to its axis as its diameter increases during the rewinding of the web on its circumference.

3. The apparatus of claim 1 wherein slitting means are provided proximate the transfer point of said web from said last roll to said rewind roll to slit said web longitudinally along said web while said web is wrapped around said last roll.

4. The apparatus of claim 3 wherein said last roll is provided with circumferential grooves to co-act with said slitting means.

5. The apparatus of claim 3 wherein said rewind roll includes a spindle adapted to hold a plurality of axially adjacent cores thereon, each for receiving a separate portion of the web which has been slit by said slitting means.

6. The apparatus of claim 1 having a processing area comprising at least one slitting blade and a heat sealing device.

7. The apparatus of claim 1 including a supply roll assembly comprising a pair of supply rolls, each supply roll having sheet material wound thereon, and means for mating the sheet material from each supply roll in face-to-face engagement to form said web.

8. An apparatus for processing and rewinding an easily stretchably deformable web made of thin plastic comprising:

(a) means for drawing and transporting a web for processing at a constant speed and tension including a series of synchronously, positively driven rolls having a last roll, said last roll providing a positively driven web moving drum on which the web travels;

(b) a center-driven rewind roll spindle onto which the web is rewound as a rewind roll; and (c) drive means for driving said rewind roll spindle and said driven rolls, said drive means driving the rewind roll spindle to impart a driving force on the rewind roll, said drive means having clutch means for permitting the speed of the rewind roll on said spindle to be varied from the speed imparted by said drive means wherein said rewind roll is maintained in peripheral contact with said web moving drum during rewinding such that the moving web is directly transferred to said rewind roll from said web moving drum at the peripheral contact between the web moving drum and the rewind roll such that the peripheral contact of said web moving drum in conjunction with said clutch means matches the circumferential speed of said rewind roll to the speed of the moving web while limiting the amount of tension exerted on the web by the spindle to thereby uniformly rewind said web without stretching.

9. An apparatus according to claim 8 further comprising slitting means associated with said web moving drum for slitting the web longitudinally of the web so that the web is slit into at least two components while said web travels on said web moving drum such that said slit components are rewound onto said rewind roll contiguously without overlap.

10. The apparatus of claim 9 wherein said rewind roll spindle includes a plurality of axially adjacent cores thereon, each core for receiving a separate component of the web which has been slit by said slitting means.

11. A method for processing and rewinding an easily stretchable plastic web comprising:

(a) driving a series of rolls to draw the web from a supply roll assembly under constant tension and to move the web at a selected speed, said series of rolls having a driven last roll;

(b) transferring the moving web from the driven last roll directly onto a rewind roll which is in peripheral contact with said last roll; and (c) center driving said rewind roll at a speed greater than the speed of the moving web, said peripheral contact between the last roll and the rewind roll creating a drag on said rewind roll for controlling the rewind speed of the rewind roll to match the speed of the moving web.

12. The method of claim 11 wherein the web is formed from at least one layer of single ply sheet material.

* * * * *